US006849591B1

(12) United States Patent
Boeckh et al.

(10) Patent No.: US 6,849,591 B1
(45) Date of Patent: Feb. 1, 2005

(54) MICROCAPSULE PREPARATIONS AND DETERGENTS AND CLEANING AGENTS CONTAINING MICROCAPSULES

(75) Inventors: Dieter Boeckh, Limburgerhof (DE); Ekkehard Jahns, Weinheim (DE); Werner Bertleff, Viernheim (DE); Peter Neumann, Mannheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 88 days.

(21) Appl. No.: 10/019,312

(22) PCT Filed: Jul. 7, 2000

(86) PCT No.: PCT/EP00/06458

§ 371 (c)(1),
(2), (4) Date: Jan. 9, 2002

(87) PCT Pub. No.: WO01/04257

PCT Pub. Date: Jan. 18, 2001

(30) Foreign Application Priority Data

Jul. 9, 1999 (DE) ..... 199 32 144

(51) Int. Cl.[7] ..... C11D 3/37; C11D 3/50; C11D 17/00

(52) U.S. Cl. ..... 510/475; 510/101; 510/298; 510/300; 510/302; 510/320; 510/349; 510/361; 510/392; 510/434; 510/438; 510/441; 510/443; 510/452; 510/476

(58) Field of Search ..... 510/101, 298, 510/300, 302, 320, 349, 361, 392, 434, 438, 441, 443, 452, 475, 476

(56) References Cited

U.S. PATENT DOCUMENTS

| | | | | |
|---|---|---|---|---|
| 3,681,248 A | | 8/1972 | Shepherd et al. | |
| 3,966,902 A | | 6/1976 | Chromecek | |
| 5,188,753 A | | 2/1993 | Schmidt et al. | |
| 5,460,817 A | * | 10/1995 | Langley et al. | 424/408 |
| 5,596,051 A | | 1/1997 | Jahns et al. | |
| 5,972,508 A | | 10/1999 | Boeckh et al. | |

FOREIGN PATENT DOCUMENTS

| | | | | |
|---|---|---|---|---|
| DE | 23 60 384 | | 6/1974 | |
| DE | 43 21 205 | | 1/1995 | |
| FR | 2 774 390 | | 8/1999 | |
| JP | 53 094274 | | 8/1978 | |
| WO | 91 15947 | | 10/1991 | |
| WO | WO 97/24177 | * | 7/1997 | B01J/13/16 |
| WO | 97 24178 | | 7/1997 | |
| WO | WO 97/24177 | * | 10/1997 | B01J/13/16 |
| WO | WO 01/04257 | * | 1/2001 | C11D/17/00 |

* cited by examiner

*Primary Examiner*—Brian P Mruk
(74) *Attorney, Agent, or Firm*—Oblon, Spivak, McClelland, Maier & Neustadt, P.C.

(57) ABSTRACT

A description is given of a microcapsule formulation comprising microcapsules having a core of a hydrophobic material and a capsule shell of an addition polymer containing in copolymerized form at least 1% by weight of cationogenic monomers and/or polyethylenically unsaturated monomers whose unsaturated sites are connected via successive chemical bonds of which at least one bond is acid-hydrolyzable. A description is further given of a microcapsule formulation comprising microcapsules having a core of a hydrophobic material, which comprises at least one fragrance or perfume, and a shell of an addition polymer containing in copolymerized form at least 1% by weight of anionogenic monoethylenically unsaturated monomers and/or polyethylenically unsaturated monomers whose unsaturated sites are connected via successive chemical bonds of which at least one bond is base-hydrolyzable. The microcapsule formulations are employed in laundry detergents or cleaning products.

27 Claims, No Drawings

MICROCAPSULE PREPARATIONS AND DETERGENTS AND CLEANING AGENTS CONTAINING MICROCAPSULES

The present invention relates to microcapsule formulations and to laundry detergent and cleaning product compositions comprising microcapsules, said microcapsules containing in their core a hydrophobic material and, in particular, a fragrance or perfume.

The majority of laundry detergent and cleaning product compositions comprise fragrances or perfumes in order to impart a pleasant fragrance to the compositions themselves or to the surfaces or textiles they are used to treat. Said fragrances or perfumes are usually compounds having two or more conjugated double bonds which are more or less sensitive to various chemicals or to oxidation. Consequently, there may be unwanted interactions with other ingredients of the detergents or cleaning products, such as surf actants or bleaches, for example, as a result of which the perfume is decomposed and/or the odor note is altered. Another problem is the occasionally high volatility of the fragrances or perfumes, which means that a large part of the quantity of perfume originally admixed to the detergent or cleaning product has escaped before the time of use. To overcome the problems addressed above, it has already been proposed to incorporate the fragrances or perfumes in microencapsulated form into the detergents or cleaning products.

For instance, U.S. Pat. No. 5,188,753 discloses a detergent composition which besides surface-active substances comprises perfume particles containing a perfume dispersed in a solid core of polyethylene, polyamide, polystyrene or the like, the particles being encapsulated within a friable shell of, for example, urea-formaldehyde resins. Under exposure to mechanical force, the capsules break up and, in doing so, release the enclosed perfume. It is unclear whether the capsules break up during the washing or cleaning process or during the subsequent handling of the treated textiles or surfaces.

A disadvantage of the known, mechanically destructable capsules is that release of the fragrance or perfume they contain is difficult to control and depends on more or less random factors. It may be the case, for instance, that a large part of the fragrance or perfume present is released prematurely, when for example pulverulent detergents are being prepared or processed, or that a large part of the micrcocapsules enter the wastewater unchanged, together with the used washing liquor, without having released their contents.

DE 43 21 205 discloses microcapsules whose shell contains from 1 to 100% by weight of certain carboxylic anhydrides. The hydrophobic core material consists, for example, of a tackifying resin.

EP 0 839 902 discloses microcapsules containing bleaching aids.

It is an object of the present invention to provide microcapsule formulations or laundry detergents or cleaning products comprising microcapsules, where the time of release of the fragrance or perfume, or other ingredients, that is or are present in the microcapsules is precisely predeterminable.

We have found that this object is achieved by means of microcapsules whose capsule shells are destabilized by a change in pH.

The invention therefore provides a microcapsule formulation DE comprising microcapsules having a core of a hydrophobic material and a shell of an addition polymer containing in copolymerized form at least 1% by weight of cationogenic monomers and/or polyethylenically unsaturated monomers whose unsaturated sites are connected via successive chemical bonds of which at least one bond is acid-hydrolyzable.

The invention further provides a microcapsule formulation comprising microcapsules having a core of a hydrophobic material, which includes at least one fragrance or perfume, and a shell of an addition polymer containing in copolymerized form at least 1% by weight of anionogenic monoethylenically unsaturated monomers and/or polyethylenically unsaturated monomers whose unsaturated sites are connected via successive chemical bonds of which at least one bond is base-hydrolyzable.

The invention provides, moreover, a laundry detergent or cleaning product composition which comprises an above microcapsule formulation.

The microcapsules used in accordance with the invention have the feature that their capsule shell ca n be destabilized by a change in pH, e.g., by transferring the microcapsules into an acidic or basic medium. The destabilization can be brought about by an increase in the solubility of the capsule shell, with the formation of ionic sites, or by a loss of crosslinking or by a combination of both modes of action.

Microcapsules having a shell of an addition polymer containing in copolymerized form anionogenic polymers and/or polyethylenically unsaturated monomers having a base-hydrolyzable bond are referred to collectively below as base-labile microcapsules. Such microcapsules possess maximum stability in the weakly acidic and neutral pH range, but are destabilized in the basic pH range.

Microcapsules having a shell of an addition polymer containing in copolymerized form cationogenic monoethylenically unsaturated monomers and/or polyethylenically unsaturated monomers having an acid-hydrolyzable bond are referred to collectively below as acid-labile microcapsules. Such microcapsules possess maximum stability in the weakly basic and neutral pH range, but are destabilized in the acidic pH range.

The hydrophobic material which in certain embodiments of the invention includes a fragrance or perfume is preferably an oil which is liquid at 20° C. or a material which is meltable in the temperature range from 20 to 100° C., possesses moderate or zero solubility in water at this temperature, and forms an emulsion. The partition coefficient $\log_{10} P_{ow}$ of the hydrophobic material between octanol and water is preferably more than 0.5, in particular more than 1.0. If, within the stated temperature range, the hydrophobic material does not form a liquid, water-emulsifiable oil, then its solubility in the aqueous phase can be reduced, for example, by adding electrolytes, such as salts, examples being alkali metal sulfates, such as sodium sulfate, and also the corresponding silicates or phosphates.

Hydrophobic materials which can be used are in principle all substances or mixtures which can be emulsified in water at temperatures between their melting point and the boiling point of water. They include all kinds of oils, such as vegetable oils, animal oils, mineral oils, paraffins, chlorinated paraffins, fluorocarbons, and other synthetic oils. Typical examples are sunflower oil, rapeseed oil, olive oil, peanut oil, soya oil, kerosine, benzene, toluene, butane, pentane, hexane, cyclohexane, chloroform, carbon tetrachloride, chlorinated biphenyls, and silicone oils. It is also possible to use high boiling point hydrophobic mater ials, examples being diethyl phthalate, dibutyl phthalate, diisohexyl phthalate, dioctyl phthalate, alkylnaphthalenes, dodecylbenzene, terphenyl, and partially hydrogenated terphenyls. Polymers can also be used as hydrophobic core material provided they are emulsifiable in water. This proviso is generally met when the glass transition temperature of the polymers is below the temperature at which the polymers are emulsified in water. Examples of such polymers are homopolymers or copolymers of $C_1$–$C_{20}$ alkyl acrylates, homopolymers or copolymers of $C_3$–$C_{20}$ methacrylates, copolymers of styrene and styrene derivatives with acrylates or methacrylates, polyesters, oligomeric polyolefins based on ethylene, propylene or isobutylene, polyamides, and polycarbonates having a hydrophobic character. Suitable examples are polybutyl acrylate, polyethylhexyl acrylate, poly(styrene-co-n-butyl acrylate) and cold-polymerized poly(styrene-co-butadiene). Mixtures of two or more of the materials described, and mixtures of low molecular mass hydrophobic materials with water-emulsifiable polymers, can also be used as the hydrophobic material.

The term fragrance or perfume refers to all organic substances which have a desired olfactory property and are essentially nontoxic. They include all perfumes or fragrances commonly used in laundry detergent or cleaning product compositions or in perfumery. They can be compounds of natural, semisynthetic, or synthetic origin. Preferred fragrances or perfumes can be assign ed to the classes of the hydrocarbons, aldehydes or esters. The fragrances or perfumes also include natural extracts and/or essences which may comprise complex mixtures of constituents, such as orange oil, lemon oil, rose extract, lavender, musk, patchouli, balsam essence, sandalwood oil, pine oil, and cedar oil.

Nonlimitative examples of synthetic and semisynthetic fragrances and perfumes are: 7-acetyl-1,2,3,4,5,6,7,8-octahydro-1,1,6,7-tetramethyl-naphthalene, α-ionone, β-ionone, γ-ionone α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetrlnin, 4-acetyl-6-tert-butyl-1,1-dimethylindane, hydroxyphenylbutanone, benzophenone, methyl β-naphthyl ketone, 6-acetyl-1,1,2,3,3,5-hexamethylindane, 5-acetyl-3-isopropyl-1,1,2,6-tetramethylindane, 1-dodecanal, 4-(4-hydroxy-4-methylpentyl)-3-cyclohexene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal a nd methyl anthranilate, condensation products of hydroxycitronellal and indole, condensation products of phenylacetaldehyde and indole, 2-methyl-3-(para-tert-butylphenyl) propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethyl-cyclopenta-γ-2-benzopyran, β-naphthol methyl ether, ambroxane, dodecahydro-3a,6,6,9a-tetramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, and tert-butylcyclohexyl acetate.

Particular preference is given to the following: hexylcinnamaldehyde, 2-methyl-3 (tert-butylphenyl)-propionaldehyde, 7-acetyl-1,2,3,4,5,6,7,8-octahydro-1,1,6,7-tetramethylnaphthalene, benzyl salicylate, 7-acetyl-1,1,3,4,4,6-hexamethyltetralin, para-tert-butylcyclohexyl acetate, methyl dihydrojasmonate, β-naphthol methyl ether, methyl β-naphthyl ketone, 2-methyl-2-(para-iso-propylphenyl) propionaldehyde, 1,3,4,6,7,8-hexahydro-4,6,6,7,8,8-hexamethylcyclopenta-γ-2-benzopyran, dodecahydro-3a,6,6,9a-tetramethylnaphtho[2,1b]furan, anisaldehyde, coumarin, cedrol, vanillin, cyclopentadecanolide, tricyclodecenyl acetate and tricyclodecenyl propionates.

Other fragrances are essential oils, resinoids and resins from a large number of sources, such as, for example, Peru balsam, olibanum resinoid, styrax, labdanum resin, nutmeg, cassia oil, benzoin resin, coriander, and lavandin. Further suitable fragrances include: phenylethyl alcohol, terpineol, linalool, linalyl acetate, geraniol, nerol, 2-(1,1-dimethylethyl)cyclohexanol acetate, benzyl acetate, and eugenol.

The fragrances or perfumes can be used as single substances or in a mixture with one another. The fragrance or perfume may, as the sole hydrophobic material, form the core of the microcapsules. Alternatively, the microcapsules may in addition to the fragrance or perfume include a further hydrophobic material in which the fragrance or perfume is dissolved or dispersed. For example, when using fragrances or perfumes which are solid at room temperature, the use of a hydrophobic material which is liquid at room temperature, as a solvent or dispersant, is advantageous. Similarly, an oil may be added to the fragrance or perfume in order to increase its hydrophobicity.

The fragrance or perfume, or the mixture of fragrances or perfumes, preferably accounts for from 1 to 100% by weight, in particular from 20 to 100% by weight, of the hydrophobic core material.

Preferred hydrophobic materials, moreover, are those which act as active substances in a laundry detergent or cleaning product composition and which, per se or as a mixture with other hydrophobic substances, are emulsifable in water. Examples are bleach activators, foam suppressants, optical brighteners, enzymes or enzyme mixtures, or mixtures of said active substances with other hydrophobic substances.

Examples of bleach activators that can be used include N-octanoylcaprolactam, N-octanoylaminodiacetonitrile, O-octanoylacetone oxime and isopropenyl acetate.

Examples of foam suppressants that can be used include paraffins, fatty acid esters, and organic polysiloxanes.

Examples of optical brighteners that can he used include bis(styryl)biphenyls, aminocoumarins, and optical brighteners available from Ciba-Geigy under the designation Tinopal®.

Examples of enzymes that can be used are lipases such as Lipolase® and Lipolase Ultra®, which are available from Novo Nordisk.

The shell of the base-labile microcapsules of the present invention comprises an addition polymer containing in copolymerized form at least one 1% by weight, preferably at least 5% by weight, in particular at least 10% by weight, based on total monomer units, of anionogenic monoethylenically unsaturated monomers and/or polyethylenically unsaturated monomers whose unsaturated sites are connected via successive chemical bonds of which at least one bond is base-hydrolyzable. Anionogenic monomers are used with particular preference in amounts of from 5 to 30% by weight, polyethylenically unsaturated monomers with a base-hydrolyzable bond in amounts of from 5 to 50% by weight.

Anionogenic monomers are monomers which have side groups which are uncharged in the acidic and neutral pH range but have an anionogenic charge character in the basic pH range. The transition from the uncharged state to the state comprising an anionic charge character can take place as a result of deprotonation or hydrolysis or by combined deprotonation/hydrolysis. Examples of suitable anionogenic monomers are ethylenically unsaturated monocarboxylic or dicarboxylic acids or intramolecular anhydrides of ethylenically unsaturated dicarboxylic acids.

Suitable monoethylenically unsaturated monocarboxylic acids have generally 3 to 20, preferably 3 to 12, especially 3 to 6 carbon atoms. Examples that may be listed include acrylic acid, methacrylic acid, ethylacrylic acid, allylacetic acid, crotonic acid, vinylacetic acid, and the like. Suitable monoethylenically unsaturated dicarboxylic acids have generally 4 to 20, preferably 4 to 12, especially 4 to 6 carbon atoms. Examples that may be listed include maleic acid, mono- and di-($C_1$–$C_{12}$)-alkylmaleic acid, itaconic acid, mesaconic acid, fumaric acid, citraconic acid, and methylenemalonic acid. The ethylenically unsaturated dicarboxylic acids can also be in the form of their monoesters with, for example, $C_1$–$C_{12}$, preferably $C_1$–$C_6$, alkanols, such as, for example, mono-($C_1$–$C_6$)-alkyl maleates. Also suitable are the intramolecular anhydrides of the abovementioned ethylenically unsaturated dicarboxylic acids. Examples of intramolecular anhydrides of dicarboxylic acids are maleic anhydride, dimethylmaleic anhydride, itaconic anhydride, and citraconic anhydride. If maleic anhydride is used, it is employed advantageously in an amount of more than 40% by weight, based on total monomer units.

The conversion that takes place in the basic medium of the copolymerized anionogenic monomer units to units having a complete anionic charge or a multiple thereof greatly increases the solubility of the capsule shell. By this means the capsule shell is partly or completely dissolved, the microcapsules spontaneously liberating their contents or fragmenting under slight mechanical load. Whereas the deprotonation of the monoethylenically unsaturated monocarboxylic and/or dicarboxylic acids is relatively rapid, the hydrolysis of the intramolecular dicarboxylic anhydrides, with formation of anionic sites, is a comparatively slow process. Through a suitable selection of the anionogenic monoethylenically unsaturated monomers, therefore, it is possible to control closely the rate of destabilization of the microcapsules.

For the purposes of the present invention, a base-hydrolyzable bond is one which is hydrolyzed in aqueous solution by the action of a base, in the pH range from 8 to 14, for example. The base-hydrolyzable bond is preferably a carboxylic anhydride bond.

Suitable polyethylenically unsaturated monomers having a base-hydrolyzable bond are, accordingly, the intermolecular anhydrides of monoethylenically unsaturated monocarboxylic acids having generally 3 to 20, preferably 3 to 12, especially 3 to 6 carbon atoms. They can be symmetrical or asymmetrical anhydrides of unsaturated monocarboxylic acids. Examples of suitable monoethylenically unsaturated carboxylic acids are acrylic acid, methacrylic acid, ethylacrylic acid, allylacetic acid, crotonic acid, vinylacetic acid, vinylbenzoic acid, and the like. Also suitable are the symmetrical or asymmetrical anhydrides of monoesters of monoethylenically unsaturated dicarboxylic acids with one another or with ethylenically unsaturated monocarboxylic acids. Acrylic anhydride, methacrylic anhydride, and 4-vinylbenzoic anhydride are preferred.

The copolymerized units of the polyethylenically unsaturated monomers having a base-hydrolyzable bond act as temporary crosslinkers whose crosslinking action is removed by hydrolysis of a bond in a basic medium, so destabilizing the capsule shell.

Acid-labile microcapsules of the present invention have a capsule shell comprising an addition polymer containing in copolymerized form at least 1% by weight, preferably at least 5% by weight, in particular at least 10% by weight, based on total monomer units, of cationogenic monoethylenically unsaturated monomers and/or polyethylenically unsaturated monomers whose unsaturated sites are connected via successive chemical bonds of which at least one bond is acid-hydrolyzable. Cationogenic monomers are used with particular preference in amounts of from 5 to 30% by weight, polyethylenically unsaturated monomers having an acid-hydrolyzable bond in amounts of from 5 to 50% by weight.

Cationogenic monomers are monomers which have side groups which are uncharged at basic and neutral pH but take on a cationic charge character in the acidic pH range. The transition from the uncharged state to a state comprising a cationic charge character takes place, for example, as a result of protonation.

Examples of suitable cationogenic-monomers are aminoalkyl (meth)acrylates and/or aminoalkyl(meth) acrylamides. The aminoalkyl(meth)acrylates have, for example, the formula I (I)

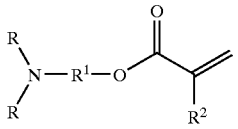

where the radicals R independently of one another are hydrogen, $C_1$–$C_8$ alkyl, $C_1$–$C_8$ hydroxyalkyl or polyoxy ($C_1$–$C_4$)alkylene of 2 to 500 alkylene units or two radicals R together with the nitrogen atom to which they are attached form a 5- to 8-membered, preferably saturated, ring; $R^1$ is $C_1$–$C_{18}$ alkylene, preferably $C_2$–$C_6$ alkylene, and $R^2$ is hydrogen or methyl. The aminoalkyl(meth)acrylamides have, for example, the formula II (II)

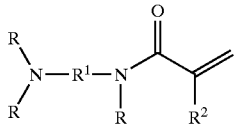

where R, $R^1$ and $R^2$ are as defined above. Suitable examples are N-dimethylaminopropylmethacrylamide, N,N-dimethylaminoethyl methacrylate, N,N-dimethylaminoethyl acrylate, 2-tert-butylaminoethyl methacrylate, 2-N-morpholinoethyl methacrylate, 2-N-morpholinoethyl acrylate, and 3-dimethylaminoneopentyl acrylate.

The aminoalkyl(meth)acrylates and aminoalkyl(meth) acrylamides are readily protonated on the amino group in the acidic pH range, thereby increasing the solubility of the polymers containing them in aqueous medium. This results in a destabilization of the microcapsules having a capsule shell comprising such an addition polymer.

For the purposes of the present invention, an acid-hydrolyzable bond is a bond which is hydrolyzed in aqueous solution by a dilute acid, for example, at a pH of from 2 to 7. The acid-hydrolyzable bond is preferably a carboxamide bond.

Suitable polyethylenically unsaturated monomers having an acid-hydrolyzable bond are alkylenebis(meth) acrylamides. Preferably, the alkylenebis(meth)acrylamides are of the formula III (III)

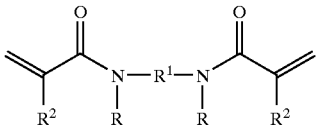

where R, $R^1$ and $R^2$ are as defined above. Suitable examples are N,N'-methylenebisacrylamide and N,N'-hexamethylenebismethacrylamide.

The copolymerized polyethylenically unsaturated monomers having an acid-hydrolyzable bond act as temporary crosslinkers whose crosslinking action is removed by hydrolysis in acidic medium, thereby destabilizing the shell of the microcapsules.

In addition to the monomer discussed above, the polymer that forms the capsule shell can contain further monomers in copolymerized form. Suitable monomers contain in copolymerized form:

- from 1 to 100% by weight, preferably from 5 to 100% by weight, in particular from 10 to 100% by weight, of the abovementioned anionogenic monoethylenically unsaturated monomers and/or polyethylenically unsaturated monomers whose unsaturated sites are connected via successive chemical bonds of which at least one bond is base-hydrolyzable; or
- cationogenic monoethylenically unsaturated monomers and/or polyethylenically unsaturated monomers whose unsaturated sites are connected via successive chemical bonds of which at least one bond is acid-hydrolyzable,
- from 0 to 95% by weight of neutral monoethylenically unsaturated monomers,
- from 0 to 80% by weight of monomers having a permanent crosslinking action, containing at least two ethylenically unconjugated double bonds per molecule, and
- from 0 to 20% by weight of water-soluble monoethylenically unsaturated monomers, the amounts of the monomers adding up to 100% by weight.

The neutral—i.e., not anionogenic or cationogenic monoethylenically unsaturated monomers are, for example, acrylic esters or methacrylic esters of monohydric $C_1$–$C_{24}$ alcohols, examples being methyl acrylate, methyl methacrylate, ethyl acrylate, ethyl methacrylate, n-propyl acrylate, n-propyl methacrylate, isopropyl acrylate, isopropyl methacrylate, n-butyl acrylate, isobutyl acrylate, tert-butyl acrylate, n-butyl methacrylate, isobutyl methacrylate, tert-butyl methacrylate, cyclohexyl acrylate, cyclohexyl methacrylate, phenyl acrylate, phenyl methacrylate, octyl acrylate, octyl methacrylate, 2-ethylhexyl acrylate, 2-ethylhexyl methacrylate, lauryl acrylate, lauryl methacrylate, stearyl acrylate, palmityl acrylate, stearyl methacrylate and palmityl methacrylate; vinylaromatic compounds, such as styrene and α-methylstyrene, vinylpyridine; vinyl esters of $C_1$–$C_{20}$ carboxylic acids, such as vinyl acetate, vinyl propionate; methacrylonitrile; methacrylamide, N-methylmethacrylamide, dimethylaminopropylmethacrylamide, dimethylaminoethyl acrylate, dimethylaminoethyl methacrylate, vinylcyclohexane, vinyl chloride, vinylidene chloride, 2-hydroxypropyl acrylate and 2-hydroxypropyl methacrylate.

The neutral monoethylenically unsaturated monomers, if used, are employed in amounts of up to 95% by weight, e.g., from 5 to 95% by weight, preferably up to 90% by weight. Neutral monoethylenically unsaturated monomers used with preference are methyl methacrylate, methyl acrylate, ethyl acrylate, ethyl methacrylate, styrene, methacrylonitrile, vinyl acetate, and vinylpyridine.

Monomers having a permanent crosslinking action that can be used are, for example, acrylic and methacrylic esters derived from dihydric $C_2$–$C_{24}$ alcohols, examples being ethylene glycol diacrylate, propylene glycol diacrylate, ethylene glycol dimethacrylate, propylene glycol dimethacrylate, 1,4-butanediol diacrylate, 1,4-butanediol dimethacrylate, 1,6-hexanediol diacrylate and 1,6-hexanediol dimethacrylate, divinylbenzene, methallylmethacrylamide, allyl methacrylate, allyl acrylate, methylenebisacrylamide, trimethylolpropane triacrylate, trimethylolpropane trimethacrylate, pentaerythritol triallyl ether, pentaerythritol tetraacrylate, and pentaerythritol tetramethacrylate. If used, the monomers having a permanent crosslinking action are employed in amounts of up to 80% by weight, preferably up to 50% by weight. Use of the monomers having a permanent crosslinking action results in the microcapsule walls not dissolving completely under the action of aqueous acids or bases, respectively, but instead only swelling more or less strongly. The swelling makes the microcapsule wall more permeable for the hydrophobic material in the capsule core, thereby permitting the release of the hydrophobic material in the capsule core to be controlled by way of the amount of crosslinker used. Larger amounts of crosslinker lead in general to a slower release of the hydrophobic core of the microcapsules.

The dissolution rate or swelling rate of the microcapsules of the present invention can be further modified, if desired, by the use of water-soluble monomers. Examples of water-soluble monoethylenically unsaturated monomers are acrylamide, hydroxyethyl acrylate, hydroxyethyl methacrylate, vinylsulfonic acid, acrylamidomethylpropanesulfonic acid, styrenesulfonic acid, sulfoethyl acrylate, sulfoethyl methacrylate, sulfopropyl acrylate, sulfopropyl methacrylate, and acrylonitrile. If used, these monomers are employed in amounts of up to 20% by weight, preferably up to 10% by weight.

The weight proportion of the hydrophobic core material with respect to the entire capsule is preferably from 50 to 98%, in particular from 70 to 95%. The microcapsules preferably have an average diameter of from 1 to 100 μm, in particular from 2 to 50 μm. The average diameter is defined as the volume average of a capsule size distribution, measurable for example by Fraunhofer r, diffraction (Malvern Mastersizer) or by measuring individual particles in capillaries (Coulter Counter).

The microcapsules are obtainable by polymerizing a monomer mixture constituting the capsule shell in the oil phase of a stable oil-in-water emulsion, said oil phase consisting of an abovementioned hydrophobic material containing at least one fragrance or perfume in accordance with defined aspects of the invention. This production process is known per se and is described, for example, in DE-A-4321205.

The core of the microcapsules is formed by a water-emulsifiable hydrophobic material. The hydrophobic material serves simultaneously as solvent or dispersant for the monomer mixture used in preparing the capsule shells by polymerization. Polymerization then takes place in the oil phase of a stable oil-in-water emulsion. This emulsion is obtained by, for example, first dissolving the monomers and the polymerization initiator, together if desired with a polymerization regulator, in the hydrophobic material and emulsifying the resulting solution in an aqueous medium with an emulsifier and/or protective colloid. Alternatively, the hydrophobic phase or constituents thereof can first be emulsified in the aqueous phase and then the monomers or the polymerization initiator, and any auxiliaries which it may also be desired to use, such as protective colloids or polymerization regulators, can be added to the emulsion. In another variant of the process, the hydrophobic material and the monomers can also be emulsified in water, with only the polymerization initiator being added subsequently. Since the hydrophobic material is to be microencapsulated as fully as possible in the emulsion, it is preferred to use only those hydrophobic materials whose solubility in water is limited. The solubility should preferably not exceed 5% by weight. For complete encapsulation of the hydrophobic material in the oil phase of the oil-in-water emulsion it is judicious to select the monomers in accordance with their solubility in the hydrophobic material. While the monomers are essentially soluble in the oil, their polymerization in the individual oil droplets produces oligomers and polymers which are soluble neither in the oil phase nor in the water phase of the oil-in-water emulsion and which migrate to the interface between the oil droplets and the water phase. There, in the course of further polymerization, they form the wall material which ultimately encases the hydrophobic material core of the microcapsules.

In order to form a stable oil-in-water emulsion, it is common to use protective colloids and/or emulsifiers. Suitable protective colloids are, for example, cellulose derivatives, such as hydroxyethylcellulose, carboxymethylcellulose and methylcellulose, polyvinylpyrrolidone and copolymers of N-vinylpyrrolidone, polyvinyl alcohols, and partially hydrolyzed polyvinyl acetates. In addition it is also possible to use gelatin, gum arabic, xanthan gum, alginates, pectins, degraded starches, and casein. Preference is given to the use of ionic protective colloids. Ionic protective colloids which may be cited include polyacrylic acid, polymethacrylic acid, copolymers of acrylic acid and methacrylic acid, sulfo-containing water-soluble polymers containing sulfoethyl acrylate, sulfoethyl methacrylate or sulfopropyl methacrylate, and also polymers of N-(sulfoethyl)maleimide, 2-acrylamido-2-alkylsulfonic acids, styrenesulfonic acids and formaldehyde, and also condensates of phenolsulfonic acids and formaldehyde. The protective colloids are generally added in amounts of from 0.1 to 10% by weight, based on the water phase of the emulsion. The polymers used as ionic protective colloids preferably have average molecular masses of from 500 to 1,000,000, more preferably from 1000 to 500,000.

The polymerization takes place in general in the presence of polymerization initiators which form free radicals. For this purpose it is possible to use all customary peroxo compounds and azo compounds in the amounts normally employed, for example, from 0.1 to 5% by weight, based on the weight of the monomers to be polymerized. Preference is given to polymerization initiators which are soluble in the oil phase or in the monomers. Examples of these are t-butyl peroxyneodecanoate, t-butyl peroxypivalate, t-amyl peroxypivalate, dilauroyl peroxide, t-amyl peroxy-2-ethylhexanoate, and the like.

The polymerization of the oil-in-water emulsion is normally conducted at from 20 to 100° C., preferably from 40 to 90° C. Normally, the polymerization is performed under atmospheric pressure, but can also take place under reduced or increased pressure, for example, in the range from 0.5 to 20 bar. A judicious procedure is to emulsify a mixture of water, protective colloid and/or emulsifiers, hydrophobic materials, polymerization initiators and monomers to the desired droplet size of the hydrophobic material, using a high-speed disperser, and to heat the stable emulsion, with stirring, to the decomposition temperature of the polymerization initiator. The rate of polymerization can be controlled in a known manner through the choice of temperature and through the choice of the amount of the polymerization initiator. On reaching the polymerization temperature, the polymerization is judiciously continued for a further period, for example, from 2 to 6 hours, in order to complete the conversion of the monomers.

Particular preference is given to a procedure in which the temperature of the polymerizing reaction mixture is increased continuously or periodically during the polymerization. This is done with the aid of a programme with increasing temperature. For this purpose, the total polymerization time can be subdivided in to two or more periods. The first polymerization period features slow decomposition of the polymerization initiator. In the second and any further polymerization period(s), the temperature of the reaction mixture is raised in order to accelerate the decomposition of the polymerization initiators. The temperature can be raised in one or more steps or continuously in a linear or nonlinear manner. The temperature difference between the beginning and the end of the polymerization can be up to 50° C. in general, this difference is from 3 to 40° C., preferably from 3 to 30° C.

The microcapsule dispersions obtained by the procedure depicted above can subsequently be conventionally spray dried. To aid redispersion of the spray-dried microcapsules, additional amounts of emulsifier and/or protective colloid may be added if desired to the dispersions prior to spray drying. Suitable emulsifiers and/or protective colloids are those mentioned above in connection with the preparation of the microcapsule dispersion.

In general, the aqueous microcapsule dispersion is atomized in a stream of hot air which is guided in cocurrent or countercurrent, preferably in cocurrent, with the spray mist. The entry temperature of the hot air stream is usually in the range from 100 to 200° C., preferably from 120 to 160° C., and the exit temperature of the air stream is generally in the range from 30 to 90° C., preferably from 60 to 60° C. The aqueous microcapsule emulsion can be sprayed, for example, using single-fluid or multifluid nozzles or a rotating disk. The spray-dried microcapsule formulations are normally deposited using cyclones or filter separators. The liquid or spray-dried microcapsule formulations can be used to formulate laundry detergents or cleaning products.

The microencapsulation protects the fragrances and perfumes against unwanted interactions with other ingredients of the detergents or cleaning products and against premature volatilization. Release of the fragrances and perfumes from the microcapsules of the invention is induced by a change in pH therein. One embodiment of the detergent or cleaning product of the invention comprises a spray-dried base-labile microcapsule formulation of the invention together with a solid water-soluble base, or a spray-dried acid-labile microcapsule formulation together with a solid water-soluble acid. In the dry state, there is no notable interaction between the acid or base and the microcapsules. In the course of the dissolution of the detergent or cleaning product in water, the acid or base is dissolved and the aqueous solution solubilizes or destabilizes the shells of the microcapsules, which thus release their contents at a greater or lesser rate. Another embodiment of the detergent or cleaning product of the invention is a liquid composition comprising a microcapsule formulation of the invention in a liquid medium, which on dilution with water undergoes a change in pH. A change in pH during dissolution or dilution of the detergent or cleaning product may occasionally take place as a result of the basicity of the tap water, which derives from its hardness. In general, a change in pH by at least 0.5, preferably at least 1.0, with particular preference at least 1.5 pH units is sufficient to destabilize the microcapsules of the invention.

The laundry detergents and cleaning products of the invention can be in liquid or solid form. In addition to the microcapsule formulations of the invention, they generally comprise further customary constituents. The customary constituents of laundry detergents for textiles include, inter alia, bleaches, bleach activators, builder substances, i.e., inorganic builders and/or organic cobuilders, and surfactants, especially anionic and/or nonionic surfactants. Further auxiliaries and co-components are standardizing agents, complexing agents, phosphates, dyes, corrosion inhibitors, grayness inhibitors (antiredeposition agents) and/or soil release polymers, color transfer inhibitors, bleach catalysts, peroxide stabilizers, electrolytes, optical brighteners, enzymes, uncapsulated perfume oils, foam regulators, and activating substances. The selection of appropriate auxiliaries is within the expertise of the skilled worker. In the present case, the laundry detergents also include textile aftertreatment compositions, such as fabric softeners, impregnated nonwovens which are placed in the dryer together with the wet laundry, and laundry additives which are added separately from the detergent.

Suitable inorganic builder substances are all customary inorganic builders such as aluminosilicates, silicates, carbonates, and phosphates.

Examples of suitable inorganic builders are alumosilicates having ion exchange properties such as, for example, zeolites. Various types of zeolite are suitable, especially zeolite A, X, B, P, MAP and HS in their Na form or in forms in which some of the Na has KEY been replaced by other cations such as Li, K, Ca, Mg, or ammonium. Suitable zeolites are described, for example, in EP-A 0 038 591, EP-A 0 021 491, EP-A 0 087 035, U.S. Pat. No. 4,604,224, GB-A 20 13 259, EP-A 0 522 726, EP-A 0 384 070 and WO-A-94/24 251.

Examples of further suitable inorganic builders are amorphous or crystalline silicates such as, for example, amorphous disilicates, crystalline disilicates such as the sheet silicate SKS-6 (manufacturer: Hoechst). The silicates can be used in the form of their alkali metal, alkaline earth metal or ammonium salts. Preference is given to the use of Na, Li and Mg silicates.

Examples of suitable anionic surfactants are fatty alcohol sulfates of fatty alcohols having 8 to 22, preferably 10 to 18, carbon atoms, e.g., $C_9$–$C_{11}$ alcohol sulfates, $C_{12}$–$C_{13}$ alcohol sulfates, cetyl sulfate, myristyl sulfate, palmityl sulfate, stearyl sulfate, and tallow fatty alcohol sulfate.

Further suitable anionic surfactants are sulfated ethoxylated $C_8$–$C_{22}$ alcohols (alkyl ether sulfates) and their soluble salts. Compounds of this kind are prepared, for example, by first alkoxylating a $C_8$–$C_{22}$, preferably a $C_{10}$–$C_{18}$ alcohol, e.g., a fatty alcohol, and then sulfating the alkoxylation product. For the alkoxylation it is preferred to use ethylene oxide, with from 2 to 50, preferably from 3 to 20 mol of ethylene oxide b eing used per mole of fatty alcohol. Alternatively, the alcohols can be alkoxylated with propylene oxide alone and, if desired, with butylene oxide. Also suitable are alkoxylated $C_8$–$C_{22}$ alcohols containing ethylene oxide and propylene oxide, or ethylene oxide and butylene oxide. The alkoxylated $C_8$ or up to $C_{22}$ alcohols can contain the ethylene oxide, propylene oxide and butylene oxide units in the form of blocks or in random distribution.

Further suitable anionic surfactants are alkanesulfonates such as $C_8$–$C_{24}$, preferably $C_{10}$–$C_{18}$, alkanesulfonates, and also soaps such as, for example, the salts of $C_8$–$C_{24}$ carboxylic acids.

Further suitable anionic surfactants are $C_9$–$C_{20}$ linear alkylbenzenesulfonates (LAS).

The anionic surfactants are added to the laundry detergent preferably in the form of salts. Suitable salts are alkali metal salts such as sodium, potassium and lithium, and ammonium salts such as, for example, hydroxyethylammonium, di(hydroxyethyl)ammonium, and tri(hydroxyethyl) ammonium salts.

Examples of suitable nonionic surfactants are alkoxylated $C_8$–$C_{22}$ alcohols such as fatty alcohol alkoxylates or oxo alcohol alkoxylates. The alkoxylation can be carried with ethylene oxide, propylene oxide and/or butylene oxide. As surfactant in this case it is possible to use all alkoxylated alcohols which contain at least two molecules of an above-mentioned alkylene oxide in the adduct. Also suitable in this case are block polymers of ethylene oxide, propylene oxide and/or butylene oxide, or adducts which contain said alkylene oxides in random distribution. From 2 to 50, preferably from 3 to 20 mol of at least one alkylene oxide are used per mole of alcohol. The alkylene oxide used is preferably ethylene oxide. The alcohols preferably have 10 to 18 carbon atoms.

A further class of suitable nonionic surfactants comprises alkylphenol ethoxylates having $C_6$–$C_{14}$ alkyl chains and from 5 to 30 mol of ethylene oxide units.

Another class of nonionic surfactants comprises alkyl polyglucosides having 8 to 22, preferably 10 to 18 carbon atoms in the alkyl chain. These compounds usually contain from 1 to 20, preferably from 1.1 to 5, glucoside units. Another class of nonionic surfactants comprises N-alkylglucamides.

The laundry detergents of the invention preferably contain $C_{10}$–$C_{16}$ alcohols ethoxylated with from 3 to 12 mol of ethylene oxide, and with particular preference ethoxylated fatty alcohols, as nonionic surfactants.

Examples of suitable low molecular mass polycarboxylates as organic cobuilders are the following:

$C_4$–$C_{20}$ di-, tri- and tetracarboxylic acids such as, for example, succinic acid, propanetricarboxylic acid, butanetetracarboxylic acid, cyclopentanetetracarboxylic acid, and alkylsuccinic and alkylenesuccinic acids having $C_2$–$C_{16}$ alkyl and alkylene radicals respectively;

$C_4$–$C_{20}$ hydroxy carboxylic acids such as, for example, malic acid, tartaric acid, gluconic acid, glutaric acid, citric acid, lactobionic acid and sucrosemono-, -di- and -tricarboxylic acids;

amino polycarboxylates such as, for example, nitrilotriacetic acid, methylglycinediacetic acid, alaninediacetic acid, ethylenediaminetetraacetic acid, and serinediacetic acid;

salts of phosphonic acids such as, for example, hydroxyethanediphosphonic acid, ethylenediaminetetra (methylenephosphonate) and diethylenetriaminepenta (methylenephosphonate).

Examples of suitable oligomeric or polymeric polycarboxylates as organic cobuilders are the following:

oligomaleic acids, as are described, for example, in EP-A 0 451 508 and EP-A 0 396 303;

copolymers and terpolymers of unsaturated $C_4$–$C_8$ dicarboxylic acids, possible comonomers present in copolymerized form being monoethylenically unsaturated monomers from group (i) in amounts of up to 95% by weight, from group (ii) in amounts of up to 60% by weight, and from group (iii) in amounts of up to 20% by weight.

Examples of suitable unsaturated $C_4$–$C_8$ dicarboxylic acids in this context are maleic acid, fumaric acid, itaconic acid, and citraconic acid. Maleic acid is preferred.

Group (i) embraces monoethylenically unsaturated $C_3$–$C_8$ monocarboxylic acids such as, for example, acrylic acid, methacrylic acid, crotonic acid, and vinylacetic acid. Acrylic acid and methacrylic acid are preferably used from group (i).

Group (ii) embraces monoethylenically unsaturated $C_2$–$C_{22}$ olefins, vinyl alkyl ethers having $C_1$–$C_8$ alkyl groups, styrene, vinyl esters of $C_1$–$C_8$ carboxylic acid, (meth)acrylamide, and vinylpyrrolidone. $C_2$–$C_6$ olefins, vinyl alkyl ethers having $C_1$–$C_4$ alkyl groups, vinyl acetate, and vinyl propionate are preferably used from group (ii).

Group (iii) embraces (meth)acrylic esters of $C_1$–$C_8$ alcohols, (meth)acrylonitrile, (meth)acrylamides, (meth) acrylamides of $C_1$–$C_8$ amines, N-vinylformamide, and vinylimidazole.

If the polymers contain copolymerized vinyl ester of group (ii), some or all of said ester may also be present in hydrolyzed form fib as vinyl alcohol structural units. Appropriate copolymers and terpolymers are known, for example, from U.S. Pat. No. 3,887,806 and DE-A 43 13 909.

Copolymers of dicarboxylic acids that are suitable as organic cobuilders are preferably the following:

copolymers of maleic acid and acrylic acid in a weight ratio of from 10:90 to 95:5, especially preferably those in the weight ratio of from 30:70 to 90:10, with molecular masses of from 10,000 to 150,000;

terpolymers of maleic acid, acrylic acid and a vinyl ester of a $C_1$–$C_3$ carboxylic acid in a weight ratio of from 10 (maleic acid):90 (acrylic acid+vinyl ester) to 95 (maleic acid):10 (acrylic acid+vinyl ester), it being possible for the weight ratio of acrylic acid to vinyl ester to vary within the range from 20:80 to 80:20, and with particular preference terpolymers of maleic acid, acrylic acid and vinyl acetate or vinyl propionate in a weight ratio of from 20 (maleic acid):80 (acrylic acid+vinyl ester) to 90 (maleic acid):10 (acrylic acid+vinyl ester), it being possible for the weight ratio of acrylic acid to vinyl ester to vary within the range from 30:70 to 70:30;

Copolymers of maleic acid with $C_2$–$C_8$ olefins in a molar ratio of from 40:60 to 80:20, particular preference being given to copolymers of maleic acid with ethylene, propylene or isobutene in a molar ratio of 50:50.

Graft polymers of unsaturated carboxylic acids on low molecular mass carbohydrates or hydrogenated carbohydrates—cf. U.S. Pat. No. 5,227,446, DE-A 44 15 623, DE-A 43 13 909—are likewise suitable as organic cobuilders.

Examples of suitable unsaturated carboxylic acids in this case are maleic acid, fumaric acid, itaconic acid, citraconic acid, acrylic acid, methacrylic acid, crotonic acid and vinylacetic acid and also mixtures of acrylic acid and maleic acid, which are grafted on in amounts of from 40 to 95% by weight, based on the component to be grafted.

For the purpose of modification it is additionally possible for up to 30% by weight, based on the component to be grafted, of further monoethylenically unsaturated monomers to be present in copolymerized form. Suitable modifying monomers are the abovementioned monomers of groups (ii) and (iii).

Suitable graft bases include degraded polysaccharides such as acidic or enzymatically degraded starches, inulins or cellulose, reduced (hydrogenated or reductively aminated) degraded polysaccharides such as mannitol, sorbitol, aminosorbitol and glucamine, and also polyalkylene glycols having molecular masses of up to $M_w$=5000 such as polyethylene glycols, ethylene oxide/propylene oxide or ethylene oxide/butylene oxide block copolymers, random ethylene oxide/propylene oxide and ethylene oxide/butylene oxide copolymers, and alkoxylated monohydric or polyhydric $C_1$–$C_{22}$ alcohols, for example; cf. U.S. Pat. No. 4,746,456.

From this group, it is preferred to use grafted degraded or degraded reduced starches and grafted polyethylene oxides, with from 20 to 80% by weight of monomers, based on the grafting component, being used in the graft polymerization. For grafting it is preferred to use a mixture of maleic acid and acrylic acid 40 in a weight ratio of from 90:10 to 10:90.

Polyglyoxylic acids as organic cobuilders are described, for example, in EP-B 0 001 004, U.S. Pat. No. 5,399,286, DE-A 41 06 355, and EP-A 0 656 914. The end groups of the polyglyoxylic acids may have different structures.

Polyamidocarboxylic acids and modified polyamidocarboxylic acids as organic cobuilders are known, for example, from EP-A 0 454 126, EP-B 0 511 037, WO-A 94/01486, and EP-A 0 581 452.

Other compounds used preferably as organic cobuilders are polyaspartic acid or cocondensates of aspartic acid with other amino acids, $C_4$–$C_{25}$ monocarboxylic or dicarboxylic acids and/or $C_4$–$C_{25}$ monoamines or diamines. Particular preference is given to the use of polyaspartic acids prepared in phosphorus acids and modified with $C_6$–$C_{22}$ monocarboxylic or dicarboxylic acids or with $C_6$–$C_{22}$ monoamines or diamines.

Condensation products of citric acid with hydroxy carboxylic 15 acids or polyhydroxy compounds as organic cobuilders are known, for example, from WO-A 93/22362 and WO-A 92/16493. Carboxyl-containing condensates of this kind usually have molecular masses of up to 10,000, preferably up to 5000.

Examples of suitable soil release polymers and/or grayness inhibitors (antiredeposition agents) for laundry detergents are the following:

polyesters made from polyethylene oxides with ethylene glycol and/or propylene glycol and aromatic dicarboxylic acids or aromatic and aliphatic dicarboxylic acids;

polyesters made from polyethylene oxides which are endgroup-capped at one end and dihydric and/or polyhydric 30 alcohols and dicarboxylic acid. Polyesters of this kind are known, for example, from U.S. Pat. No. 3,557,039, GB-A 11 54 730, EP-A 0 185 427, EP-A 0 241 984, EP-A 0 241 985, EP-A 0 272 033 and U.S. Pat. No. 5,142,020.

Further suitable soil release polymers are amphiphilic graft polymers or copolymers of vinyl and/or acrylic esters on polyalkylene oxides (cf. U.S. Pat. No. 4,746,456, U.S. Pat. No. 4,846,995, DE-A 37 11 299, U.S. Pat. No. 4,904,408, U.S. Pat. No. 4,846,994 and U.S. Pat. No. 4,849,126) or modified celluloses such as methylcellulose, hydroxypropylcellulose or carboxymethylcellulose, for example.

Examples of color transfer inhibitors used are homopolymers and copolymers of vinylpyrrolidone, of vinylimidazole, of vinyloxazolidone and of 4-vinylpyridine N-oxide having molecular masses of from 15,000 to 100,000, and also crosslinked, finely divided polymers based on these monomers. This use of such polymers is known; cf. DE-B 22 32 353, DE-A 28 14 287, DE-A 28 14 329 and DE-A 43 16 023.

Suitable enzymes are proteases, lipases, amylases, and cellulases. The enzyme system may be confined to a single one of the enzymes or may comprise a combination of different enzymes.

The microcapsules of the invention containing perfumes and odorants are used preferably in powder or granule laundry detergents and in laundry detergent tablets. These may be conventional heavy duty detergents, or detergent concentrates or compacts.

A typical (heavy duty) powder or granule laundry detergent of the invention, containing perfumes and odorants in microcapsules, may have the following exemplary composition:

from 0.5 to 50% by weight, preferably from 5 to 30% by weight, of at least one anionic and/or nonionic surfactant, the detergent formulation containing preferably not more than 8% by weight of LAS, with particular preference not more than 4% by weight of LAS, from 0.5 to 60% by weight, preferably from 15 to 40% by weight, of at least one inorganic builder, from 0 to 20% by weight, preferably from 0.5 to 8% by weight, of at least one organic cobuilder, from 0 to 35% by weight, preferably from 5 to 30% by weight, of perborate or percarbonate, from 0.001 to 2% by weight, preferably from 0.01 to 0.5% by weight, of microcapsules of the invention, from 0 to 5% by weight, preferably from 0 to 2.5% by weight, of a polymeric color transfer inhibitor, from 0 to 1.5% by weight, preferably from 0.01 to 1.0% by weight, of protease, from 0 to 1.5% by weight, preferably from 0.01 to 1.0% by weight, of other laundry detergent enzymes, from 0 to 1.5% by weight, preferably from 0.2 to 1.0% by weight, of a soil release polymer and/or grayness inhibitor, and 100% conventional auxiliaries and water.

The laundry detergents of the invention may possess different bulk densities in the range from 300 to 1200, especially from 500 to 950, g/l. Modern compact detergents generally possess high bulk densities and have a granular structure.

Cleaning products of the invention can be present in the form of a manual or machine dishwashing composition, shampoos, bath additives, general purpose cleaners for non-textile surfaces comprising, for example, metal, painted or varnished wood, or plastic, or cleaning products for ceramic articles, such as porcelain and tiles. In addition to the microcapsule formulation, cleaning products of the invention normally include surfactants, e.g., anionic or nonionic surfactants, solubilizers, polymeric cleaning enhancers, dyes, unencapsulated fragrances, and other customary additives. A review of this topic is given, for example, in HAPPI, June 1988, p. 78 (B. Milwidsky).

Cleaning products can be formulated as liquids, pastes, foams, or solids. Machine dishwashing compositions, for example, are usually formulated as powders, granules, or tablets. Powder formulations are also encountered with abrasive scouring compositions.

Normally, the compositions are sold in the form of aqueous concentrates which are used neat or diluted.

The microcapsules of the invention are particularly suitable for cleaning product formulations in powder, granule or tablet form or in liquid or paste form which result in acid- or alkali-induced opening of the microcapsules only on dilution with water.

Typical examples of anionic surfactants used in cleaning products are the following:

alkylbenzenesulfonates, alkanesulfonates, olefinsulfonates, alkyl ether sulfonates, glycerol ether sulfonates, α-methyl ester sulfonates, sulfo fatty acids, alkyl sulfates, fatty alcohol ether sulfates, glycerol ether sulfates, mixed hydroxy ether sulfates, monoglyceride (ether)sulfates, fatty acid amide (ether)sulfates, sulfosuccinates, sulfosuccinamates, sulfotriglycerides, amide soaps, ether carboxylic acids, isethionates, sarcosinates, taurides, alkyl oligoglucoside sulfates, alkyl(ether) phosphates, hydroxyalkylsarcosinates;

Typical examples of nonionic surfactants are the following: fatty acid amide polyglycol ethers, fatty and oxo alcohol polyglycol ethers, alkylphenol polyglycol ethers, fatty acid polyglycol esters, fatty amine polyglycol ethers, alkoxylated triglycerides, and block copolymers of ethylene oxide and propylene oxide and/or butylene oxide. Where the nonionic surfactants contain polyglycol ether chains, they can have a conventional or, preferably, a narrowed homolog distribution.

Typical examples of cationic surfactants are quaternary ammonium compounds and quaternized difatty acid trialkanolamine esters (ester quats).

Typical examples of amphoteric, or zwitterionic, surfactants are alkyl betaines, alkylamino betaines, aminopropionates, aminoglycinates, imidazolinium betaines, and sulfo betaines.

An overview of appropriate surfactants can be found, for example, in J. Falbe (Ed.), Surfactants in Consumer Products", Springer Verlag, Berlin 1987, pp.54–124. Further suitable surfactants for cleaning formulations are the surfactants described above for laundry detergents. The surfactants are present in amounts of from 2.5 to 90% by weight, preferably from 25 to 75% by weight, based on the active substance content. The cleaning products are normally aqueous solutions having an active substance content of from 2 to 50% by weight, preferably from 5 to 25% by weight.

Builder substances: for the cleaning products of the invention, builders used are in their entirety alkaline, organic or inorganic compounds, especially organic and/or inorganic complexing agents, which are preferably in the form of their alkali metal salts and/or amine salts and, in particular, in the form of their sodium salts and/or potassium salts. Also suitable for use in cleaner formulations are all of the builders and cobuilders described above for laundry detergents. Here, the builders also include the alkali metal hydroxides.

Suitable inorganic complexing builders in addition to polyphosphates are zeolites, bicarbonates, borates, silicates, or orthophosphates of the alkali metals.

The inorganic complexing agents of the amino polycarboxylic acid type include, inter alia, nitrilotriacetic acid, ethylenediaminetetraacetic acid, N-hydroxyethylethylenediamineacetic acid, and polyalkylenepolyamine-N-polycarboxylic acids. Examples of diphosphonic and polyphosphonic acids that may be mentioned include the following: methylenediphosphonic acid, 1-hydroxyethane-1,1-diphosphonic acid, propane-1,2,3-triphosphonic acid, butane-1,2,3,4-tetraphosphonic acid, polyvinylphosphonic acid, copolymers of vinylphosphonic acid and acrylic acid, ethane-1,2-dicarboxy-1,2-diphosphonic acid, phosphonosuccinic acid, 1-aminoethane-1,2-diphosphonic acid, aminotri(methylenephosphonic acid), methylamino- or ethylamino-di(methylenephosphonic acid), and ethylenediaminetetra(methylenephosphonic acid).

Proposed examples of N-free or P-free polycarboxylic acids or their salts as builders are in many cases, although not exclusively, compounds containing carboxyl groups. A large number of these polycarboxylic acids possess complexing properties for calcium. They include, for example, citric acid, tartaric acid, benzenehexacarboxylic acid, tetrahydrofurantetracarboxylic acid, glutaric acid, succinic acid, adipic acid, and mixtures thereof.

Cleaning intensifiers can be selected from the group consisting of water-soluble substances of high molecular mass, such as polyvinyl alcohol, polyvinylpyrrolidone, polyalkylene glycol, and carboxymethylcellulose.

pH regulators: since many household cleaning products are generally formulated to be neutral to weakly alkaline, i.e., their aqueous solution use forms have a pH in the range from 7.0 to 10.5, preferably from 7.0 to 9.5, at use concentrations of from 2 to 20 g/l, preferably from 5 to 15 g/l water or aqueous solution, the addition of acid or alkaline components, respectively, may be necessary in order to regulate the pH.

Suitable acidic substances are customary organic or inorganic acids or acidic salts, such as hydrochloric acid, sulfuric acid, bisulfates or alkalis, sulfamic acid, phosphoric acid or glutaric acid, succinic acid, adipic acid, or mixtures thereof, for example.

Solvents and solubilizers, such as lower aliphatic alcohols having 1 to 4 carbon atoms (especially ethanol), alkylarylsulfonates (especially toluene-, xylene- and/or cumenesulfonate) and lower alkyl sulfates (especially octyl sulfate and 2-ethylhexyl sulfate). Further solubilizers which can be used are water-soluble organic solvents, especially those having boiling points above 75° C., such as, for example, ethers of identical or different polyhydric alcohols, especially butyl diglycol, and also the partial ethers of ethylene glycol, propylene glycol, butylene glycol or glycerol with aliphatic $C_1$–$C_6$ alcohols.

Suitable water-soluble or water-emulsifiable organic solvents also include ketones, such as acetone and methyl ethyl ketone, and also aliphatic and cycloaliphatic hydrocarbons or terpene alcohols. The weight ratio of surfactant to solvent or solubilizer can be from 1:0 to 5:1, preferably from 1.5:1 to 3.5:1.

In order to regulate the viscosity it may be advisable to add higher polyglycol ethers having molecular weights of up to about 600, or oligoglycerol mixtures. For thickening, consideration may also be given to adding electrolyte salts, such as sodium chloride and/or magnesium chloride. The claimed compositions may further comprise additions of colorants and fragrances, preservatives, etc.

The microcapsules of the invention may be employed, moreover, in the following products: rinse and aftertreatment products for textiles, leather, wood and floors with tiles, stone, linoleum or PVC coverings, and cleaning products for carpets, rugs and upholstered furniture.

The invention is illustrated by the following examples.

EXAMPLE 1

A mixture of

| | |
|---|---|
| 499 g | of water |
| 12.5 g | of polyvinyl alcohol (88% hydrolyzed, average molecular weight 128,000) |
| 12.5 g | of polyvinylpyrrolidone of K value 90 |
| 75 g | of liquid paraffin |
| 75 g | of perfume oil (pine fragrance) |
| 4 g | of methyl methacrylate |
| 3.5 g | of methacrylate anhydride |
| 0.1 g | of t-butyl perpivalate |

is dispersed with a high-speed toothed-disk stirrer at 5500 rpm at room temperature for 20 minutes. This gives a stable oil-in-water emulsion of particles having a diameter of from 1 to 10 μm. This emulsion is heated to 59° C. with stirring using an anchor stirrer. The temperature of the oil-in-water emulsion is then raised to 63° C. over the course of one hour and to 80° C. over the course of a further 3 h. The emulsion is then cooled. The majority of microcapsules have a diameter of from 2 to 8 μm, a few up to 20 μm.

The microcapsule dispersion is drawn down on a glass plate using a coater bar, and dried. The glass plate has only a little of the fragrance odor. This glass plate is subsequently immersed for 10 minutes in water which has been adjusted to a pH of 10 using dilute sodium hydroxide solution. In the process, the microcapsules have dissolved and released part of their contents into the water, and the glass plate carrying the microcapsule film has a strong odor of pine fragrance.

EXAMPLE 2

A mixture of

| | |
|---|---|
| 512 g | of water |
| 6 g | of phenolsulfonic acid condensate |
| 8 g | of polyvinylpyrrolidone of K value 90 |
| 236 g | of liquid paraffin |
| 200 g | of pine fragrance mixture |
| 45.3 g | of methyl methacrylate |
| 39.7 g | of diethylaminoethyl methacrylate |
| 0.63 g | of azobisisobutyronitrile |
| 0.92 g | of dimethyl 2,2'-azobisisobutyrate |

is dispersed with a high-speed toothed-disk stirrer at 4500 rpm at room temperature for 20 minutes. This gives a stable oil-in-water emulsion of particles having a diameter of from 2 to 15 μm. This emulsion is heated to 60° C. with stirring using an anchor stirrer and stirred at this temperature for 1.5 hours. The temperature of the oil-in-water emulsion is then raised to 65° C. over the course of 20 minutes and stirred at this temperature for 4 h. The emulsion is then cooled. The majority of microcapsules have a diameter of from 2 to 15 μm, a few up to 40 μm.

The microcapsule dispersion is drawn down on a polyester sheet using a coater bar, and dried. The sheet has only a little of the fragrance odor. This sheet is subsequently immersed for 10 minutes in 2% strengh formic acid. In the process, the microcapsules have dissolved and released part of their contents into the aqueous acid, and the sheet carrying the microcapsule film has a strong odor of pine fragrance.

We claim:

1. A microcapsule formulation comprising, microcapsules of an average diameter of from 1 to 100 μm, having a core of a hydrophobic material and a capsule shell of an addition polymer containing in copolymerized form at least 10% by weight of cationogenic monomer(s) and/or polyethylenically unsaturated monomer(s) whose unsaturated sites are connected via successive chemical bonds of which at least one bond is acid-hydrolyzable, wherein the microcapsules are obtained by dispersing an oil phase in an aqueous medium to obtain a stable oil-in-water emulsion, the oil phase containing the hydrophobic material and a monomer mixture constituting the capsule shell, polymerizing the monomer mixture in the oil phase of the stable oil-in-water emulsion, wherein the polymer produced from the polymerization is soluble neither in the oil phase nor in the water phase of the oil-in-water emulsion and migrates to the interface between the oil droplets and the water phase and ultimately encases the hydrophobic material.

2. The microcapsule formulation of claim 1, wherein said cationogenic monomer(s) comprise aminoalkyl (meth) acrylates and/or aminoalkyl(meth)acrylamides.

3. The microcapsule formulation of claim 1, wherein said polyethylenically unsaturated monomer(s) having an acid-hydrolyzable bond comprise alkylenebis(meth)acrylamides.

4. The microcapsule formulation of claim 1, wherein said hydrophobic material comprises at least one fragrance or perfume.

5. The microcapsule formulation as claimed in of claim 1, wherein said hydrophobic material comprises at least one constituent selected from the group consisting of bleach activators, foam suppressants, optical brighteners, and enzymes.

6. The microcapsule formulation of claim 1, in spray-dried form.

7. A method for making a laundry detergent for textiles or a cleaning product for nontextile surfaces, skin or hair comprising adding the microcapsule formulation of claim 1 to a laundry detergent or cleaning product.

8. A laundry detergent or cleaning product composition comprising microcapsules having a core of a hydrophobic material, which comprises at least one fragrance or perfume, and a shell of an addition polymer containing in copolymerized form at least 10% by weight of anionogenic monoethylenically unsaturated monomer(s) and/or polyethylenically unsaturated monomer(s) whose unsaturated sites are connected via successive chemical bonds of which at least one bond is base-hydrolyzable, the weight proportion of the hydrophobic core material with respect to the entire capsule being from 50 to 98%, wherein the microcapsules are obtained by dispersing an oil phase in an aqueous medium to obtain a stable oil-in-water emulsion, the oil phase containing the hydrophobic material and a monomer mixture constituting the capsule shell, polymerizing the monomer mixture in the oil phase of the stable oil-in-water emulsion, wherein the polymer produced from the polymerization is soluble neither in the oil phase nor in the water phase of the oil-in-water emulsion and migrates to the interface between the oil droplets and the water phase and ultimately encases the hydrophobic material.

9. The composition of claim 8, wherein said anionogenic monomer(s) comprise ethylenically unsaturated $C_3$–$C_6$ monocarboxylic acids or $C_4$–$C_6$ dicarboxylic acids or monoesters or intramolecular anhydrides of ethylenically unsaturated $C_4$–$C_6$ dicarboxylic acids.

10. The composition of claim 8, wherein said polyethylenically unsaturated monomer(s) having a base-hydrolyzable bond comprise anhydrides of monoethylenically unsaturated $C_3$–$C_6$ monocarboxylic acids.

11. The composition of claim 8, further comprising at least one constituent selected from the group consisting of surfactant(s) and builder(s), or both.

12. The composition of claim 8, wherein said fragrance comprises one or more compounds selected from the group consisting of orange oil, lemon oil, rose extract, lavender, musk, patchouli, balsam essence, sandalwood oil, pine oil, and cedar oil.

13. The composition of claim 8, wherein said fragrance comprises one or more compounds selected from the group consisting of 7-acetyl-1,2,3,4,5,6,7,8-octahydro-1,1,6,7-tetramethyl-naphthalene, α-ionone, β-ionone, γ-ionone α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetralin, 4-acetyl-6-tert-butyl-1,1-dimethylindane, hydroxyphenylbutanone, benzophenone, methyl β-naphthyl ketone, 6-acetyl-1,1,2,3,3,5-hexamethylindane, 5-acetyl-3-isopropyl-1,1,2,6-tetramethylindane, 1-dodecanal, 4-(4-hydroxy-4-methylpentyl)-3-cyclohexene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal and methyl anthranilate, condensation products of hydroxycitronellal and indole, condensation products of phenylacetaldehyde and indole, 2-methyl-3-(para-tert-butylphenyl) propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethyl-cyclopenta-γ-2-benzopyran, β-naphthol methyl ether, ambroxane, dodecahydro-3a,6,6,9a-tetramethylnaphtho[2,1b]furan, cedrol, 5-(2,2,3-trimethylcyclopent-3-enyl)-3-methylpentan-2-ol, 2-ethyl-4-(2,2,3-trimethyl-3-cyclopenten-1-yl)$_2$-buten-1-ol, caryophyllene alcohol, tricyclodecenyl propionate, tricyclodecenyl acetate, benzyl salicylate, cedryl acetate, and tert-butylcyclohexyl acetate.

14. The composition of claim 8, wherein said fragrance comprises one or more compounds selected from the group consisting of Peru balsam, olibanum resinoid, styrax, labdanum resin, nutmeg, cassia oil, benzoin resin, coriander, lavandin, phenylethyl alcohol, terpineol, linalool, linalyl acetate, geraniol, nerol, 2-(1,1-dimethylethyl)cyclo-hexanol acetate, benzyl acetate, and eugenol.

15. The microcapsule formulation of claim 1, wherein said hydrophobic material comprises one or more compounds selected from the group consisting of orange oil, lemon oil, rose extract, lavender, musk, patchouli, balsam essence, sandalwood oil, pine oil, cedar oil, Peru balsam, olibanum resinoid, styrax, labdanum resin, nutmeg, cassia oil, benzoin resin, coriander, lavandin, phenylethyl alcohol, terpineol, linalool, linalyl acetate, geraniol, nerol, 2-(1,1-dimethylethyl)cyclo-hexanol acetate, benzyl acetate, and eugenol.

16. The microcapsule formulation of claim 1, wherein said hydrophobic material comprises one or more compounds selected from the group consisting of 7-acetyl-1,2,3,4,5,6,7,8-octahydro-1,1,6,7-tetramethylnaphthalene, α-ionone, β-ionone, γ-ionone α-isomethylionone, methylcedrylone, methyl dihydrojasmonate, methyl 1,6,10-trimethyl-2,5,9-cyclododecatrien-1-yl ketone, 7-acetyl-1,1,3,4,4,6-hexamethyltetralin, 4-acetyl-6-tert-butyl-1,1-dimethylindane, hydroxyphenylbutanone, benzophenone, methyl β-naphthyl ketone, 6-acetyl-1,1,2,3,3,5-hexamethylindane, 5-acetyl-3-isopropyl-1,1,2,6-tetramethylindane, 1-dodecanal, 4-(4-hydroxy-4-methylpentyl)-3-cyclohexene-1-carboxaldehyde, 7-hydroxy-3,7-dimethyloctanal, 10-undecen-1-al, isohexenylcyclohexylcarboxaldehyde, formyltricyclodecane, condensation products of hydroxycitronellal and methyl anthranilate, condensation products of hydroxycitronellal and indole, condensation products of phenylacetaldehyde and indole, 2-methyl-3-(para-tert-butylphenyl) propionaldehyde, ethylvanillin, heliotropin, hexylcinnamaldehyde, amylcinnamaldehyde, 2-methyl-2-(isopropylphenyl)propionaldehyde, coumarin, γ-decalactone, cyclopentadecanolide, 16-hydroxy-9-hexadecenoic acid lactone, 1,3,4,6,7,8-hexahydro-4,6,6,7,8,8-hexamethyl-cyclopenta-γ-2-benzopyran, β-naphthol methyl ether, ambroxane, dodecahydro-3a,6,6,9a-tetramethylnaphtho[2,1b]furan, cedrol, 5-(2,2,3-trimethylcyclopent-3-enyl)$_3$-methylpentan-2-ol, 2-ethyl-4-(2,2,3-trimethyl-3-cyclopenten-1-yl)-2-buten-1-ol, caryophyllene alcohol, tricyclodecenyl propionate, tricyclodecenyl acetate, benzyl salicylate, cedryl acetate, and tert-butylcyclohexyl acetate.

17. The microcapsule formulation of claim 1, wherein said capsule shell comprises one or more cationogenic monomer(s) selected from the group consisting of aminoalkyl(meth)acrylate(s) and aminoalkyl(meth) acrylamide(s).

18. The microcapsule formulation of claim 1, wherein said capsule shell comprises one or more cationogenic monomer(s) of formula I:

(I)

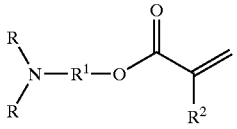

where the radicals R independently of one another are hydrogen, $C_1$–$C_8$ alkyl, $C_1$–$C_8$ hydroxyalkyl or polyoxy($C_1$–$C_4$)alkylene of 2 to 500 alkylene units or two radicals R together with the nitrogen atom to which they are attached form a 5- to 8-membered ring; $R^1$ is $C_1$–$C_{18}$ alkylene and $R^2$ is hydrogen or methyl.

19. The microcapsule formulation of claim 1, wherein said cationogenic monomer is selected from the group consisting of at least one compound of formula II:

(II)

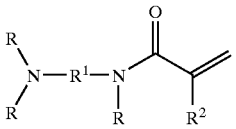

where the radicals R independently of one another are hydrogen, $C_1$–$C_8$ alkyl, $C_1$–$C_8$ hydroxyalkyl or polyoxy($C_1$–$C_4$)alkylene of 2 to 500 alkylene units or two radicals R together with the nitrogen atom to which they are attached form a 5- to 8-membered ring; $R^1$ is $C_1$–$C_{18}$ alkylene; and $R^2$ is hydrogen or methyl.

20. The microcapsule formulation of claim 1, wherein said capsule shell comprises one or more cationogenic monomer(s) selected from the group consisting of N-dimethylaminopropylmethacrylamide, N,N-dimethylaminoethyl methacrylate, N,N-dimethylaminoethyl acrylate, 2-tert-butylaminoethyl methacrylate, 2-N-morpholinoethyl methacrylate, 2-N-morpholinoethyl acrylate, and 3-dimethylaminoneopentyl acrylate.

21. The microcapsule formulation of claim 1, wherein said capsule shell comprises at least one polyethylenically unsaturated monomer(s) having an acid-hydrolyzable bond which is an alkylenebis(meth)acrylamide(s).

22. The microcapsule formulation of claim 1, wherein said capsule shell comprises at least one polyethylenically unsaturated monomer(s) having an acid-hydrolyzable bond which is an alkylenebis(meth)acrylamide(s) of the formula III:

(III)

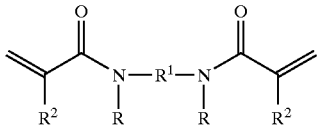

where the radicals R independently of one another are hydrogen, $C_1$–$C_8$ alkyl, $C_1$–$C_8$ hydroxyalkyl or polyoxy($C_1$–$C_4$)alkylene of 2 to 500 alkylene units or two radicals R together with the nitrogen atom to which they are attached form a 5 to 8-membered ring; $R^1$ is $C_1$–$C_{18}$ alkylene; and $R^2$ is hydrogen or methyl.

23. The microcapsule formulation of claim 1, wherein said capsule shell comprises at least one polyethylenically unsaturated monomer(s) having an acid-hydrolyzable bond which is selected from the group consisting of N,N'-methylenebisacrylamide and N,N'-hexamethylenebismethacrylamide.

24. A method for pH-mediated release of an encapsulated material comprising:

exposing microcapsules to a pH of about 2 to 7, wherein said microcapsules have an average diameter of from 1 to 100 $\mu$m, comprise a core of a hydrophobic material and a capsule shell of an addition polymer containing in copolymerized form at least 1% by weight of cationogenic monomer(s) and/or polyethylenically unsaturated monomer(s) whose unsaturated sites are connected via successive chemical bonds of which at least one bond is acid-hydrolyzable.

25. A method for pH-mediated release of an encapsulated material comprising:

exposing microcapsules to a pH of about 8 to 14, wherein said microcapsules have an average diameter of from 1 to 100 $\mu$m, comprise a core of a hydrophobic material and a capsule shell of an addition polymer containing in copolymerized form at least 1% by weight of anionogenic monomer(s) and/or polyethylenically unsaturated monomer(s) whose unsaturated sites are connected via successive chemical bonds of which at least one bond is base-hydrolyzable.

26. The microcapsule formulation of claim 18, wherein two radicals R together with the nitrogen atom to which they are attached form a saturated 5- to 8-membered ring.

27. The microcapsule formulation of claim 18, wherein $R^1$ is $C_2$–$C_6$ alkylene.

* * * * *